US007983906B2

(12) United States Patent
Gao et al.

(10) Patent No.: US 7,983,906 B2
(45) Date of Patent: Jul. 19, 2011

(54) ADAPTIVE VOICE MODE EXTENSION FOR A VOICE ACTIVITY DETECTOR

(75) Inventors: Yang Gao, Mission Viejo, CA (US); Eyal Shlomot, Long Beach, CA (US); Adil Benyassine, Irvine, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 1163 days.

(21) Appl. No.: 11/342,104

(22) Filed: Jan. 26, 2006

(65) Prior Publication Data

US 2006/0217973 A1 Sep. 28, 2006

Related U.S. Application Data

(60) Provisional application No. 60/665,110, filed on Mar. 24, 2005.

(51) Int. Cl.

| | |
|---|---|
| ***G10L 11/02*** | (2006.01) |
| ***G10L 11/06*** | (2006.01) |
| *G10L 19/00* | (2006.01) |
| *G10L 19/12* | (2006.01) |

(52) U.S. Cl. ..... 704/215; 704/213; 704/214; 704/221

(58) Field of Classification Search ..... 704/200–201, 704/206, 208–210, 211–218, 224–230, E19.001–E19.049, E11.001–E11.007; 381/56–57, 381/93–94.9

See application file for complete search history.

(56) References Cited

U.S. PATENT DOCUMENTS

| | | | | | |
|---|---|---|---|---|---|
| 4,672,669 | A | * | 6/1987 | DesBlache et al. | 704/237 |
| 5,276,765 | A | * | 1/1994 | Freeman et al. | 704/233 |
| 5,278,944 | A | * | 1/1994 | Sasaki et al. | 704/212 |
| 5,459,814 | A | * | 10/1995 | Gupta et al. | 704/233 |
| 5,509,102 | A | * | 4/1996 | Sasaki | 704/219 |
| 5,555,546 | A | * | 9/1996 | Matsumoto | 375/244 |
| 5,561,737 | A | | 10/1996 | Bowen | |
| 5,619,566 | A | * | 4/1997 | Fogel | 379/406.07 |
| 5,633,936 | A | * | 5/1997 | Oh | 381/66 |
| 5,649,055 | A | | 7/1997 | Gupta et al. | |
| 5,771,486 | A | | 6/1998 | Chan et al. | |
| 5,774,847 | A | * | 6/1998 | Chu et al. | 704/237 |
| 5,835,889 | A | * | 11/1998 | Kapanen | 704/215 |

(Continued)

FOREIGN PATENT DOCUMENTS

| | | |
|---|---|---|
| EP | 0665530 | 8/1995 |
| WO | WO 99/44191 | 9/1999 |

*Primary Examiner* — James S Wozniak
*Assistant Examiner* — David Kovacek
(74) *Attorney, Agent, or Firm* — Farjami & Farjami LLP

(57) ABSTRACT

There is provided a voice activity detection method for indicating an active voice mode and an inactive voice mode. The method comprises receiving a first portion of an input signal; determining that the first portion of the input signal includes an active voice signal; indicating the active voice mode in response to the determining that the first portion of the input signal includes the active voice signal; receiving a second portion of the input signal immediately following the first portion of the input signal; determining that the second portion of the input signal includes an inactive voice signal; extending the indicating the active voice mode for a period of time after determining that the second portion of the input signal includes the inactive voice signal, wherein the period of time varies based on one or more conditions; and indicating the inactive voice mode after expiration of the period of time.

12 Claims, 9 Drawing Sheets

U.S. PATENT DOCUMENTS 5,839,101 A * 11/1998 Vahatalo et al. ..... 704/226
5,960,389 A * 9/1999 Jarvinen et al. ..... 704/220
5,978,763 A * 11/1999 Bridges ..... 704/233
6,044,342 A * 3/2000 Sato et al. ..... 704/233
6,097,772 A * 8/2000 Johnson et al. ..... 375/346
6,154,721 A 11/2000 Sonnic et al.
6,157,670 A 12/2000 Kosanovic
6,188,981 B1 * 2/2001 Benyassine et al. ..... 704/233
6,199,036 B1 * 3/2001 Ahmadi ..... 704/207
6,275,794 B1 * 8/2001 Benyassine et al. ..... 704/207
6,385,447 B1 * 5/2002 Soleimani et al. ..... 455/427
6,424,938 B1 * 7/2002 Johansson et al. ..... 704/216
6,453,285 B1 9/2002 Anderson et al.
6,453,291 B1 9/2002 Ashley
6,490,554 B2 * 12/2002 Endo et al. ..... 704/215
6,510,409 B1 * 1/2003 Su ..... 704/233
6,606,593 B1 8/2003 Jarvinen et al.
6,633,841 B1 * 10/2003 Thyssen et al. ..... 704/233
6,658,380 B1 12/2003 Lockwood et al.
7,006,617 B1 * 2/2006 Dal Farra et al. ..... 379/206.01
7,016,834 B1 * 3/2006 Lakaniemi ..... 704/214
7,469,209 B2 * 12/2008 Chong-White et al. ..... 704/229
2001/0046843 A1 * 11/2001 Alanara et al. ..... 455/95
2002/0111798 A1 * 8/2002 Huang ..... 704/220
2002/0116186 A1 * 8/2002 Strauss et al. ..... 704/233
2002/0120440 A1 * 8/2002 Zhang ..... 704/215
2002/0198708 A1 * 12/2002 Zak et al. ..... 704/233
2003/0115046 A1 * 6/2003 Zinser et al. ..... 704/219
2004/0002856 A1 * 1/2004 Bhaskar et al. ..... 704/219
2005/0049855 A1 * 3/2005 Chong-White et al. ..... 704/219
2005/0075873 A1 * 4/2005 Makinen ..... 704/230
2005/0177364 A1 * 8/2005 Jelinek ..... 704/214
2006/0217976 A1 * 9/2006 Gao et al. ..... 704/233

* cited by examiner

ADAPTIVE VOICE MODE EXTENSION FOR A VOICE ACTIVITY DETECTOR

RELATED APPLICATIONS

The present application is based on and claims priority to U.S. Provisional Application Ser. No. 60/665,110, filed Mar. 24, 2005, which is hereby incorporated by reference in its entirety. The present application also relates to U.S. Application Ser. No. 11/342,103, filed contemporaneously with the present application, entitled "Tone Detection Algorithm for a Voice Activity Detector," and U.S. Application Ser. No. 11/342,130, filed contemporaneously with the present application, entitled "Adaptive Noise State Update for a Voice Activity Detector," which are hereby incorporated by reference in their entirety.

BACKGROUND OF THE INVENTION

1. Field of the Invention

The present invention relates generally to voice activity detection. More particularly, the present invention relates to adaptively extending voice mode in a voice activity detector.

2. Related Art

In 1996, the Telecommunication Sector of the International Telecommunication Union (ITU-T) adopted a toll quality speech coding algorithm known as the G.729 Recommendation, entitled "Coding of Speech Signals at 8 kbit/s using Conjugate-Structure Algebraic-Code-Excited Linear-Prediction (CS-ACELP)." Shortly thereafter, the ITU-T also adopted a silence compression algorithm known as the ITU-T Recommendation G.729 Annex B, entitled "A Silence Compression Scheme for Use with G.729 Optimized for V.70 Digital Simultaneous Voice and Data Applications." The ITU-T G.729 and G.729 Annex B specifications are hereby incorporated by reference into the present application in their entirety.

Although initially designed for DSVD (Digital Simultaneous Voice and Data) applications, the ITU-T Recommendation G.729 Annex B (G.729B) has been heavily used in VoIP (Voice over Internet Protocol) applications, and will continue to serve the industry in the future. To save bandwidth, G.729B allows G.729 (and its annexes) to operate in two transmission modes, voice and silence/background noise, which are classified using a Voice Activity Detector (VAD).

A considerable portion of normal speech is made up of silence/background noise, which may be up to an average of 60 percent of a two-way conversation. During silence, the speech input device, such as a microphone, picks up environmental noise. The noise level and characteristics can vary considerably, from a quiet room to a noisy street or a fast-moving car. However, most of the noise sources carry less information than the speech; hence, a higher compression ratio is achievable during inactive periods. As a result, many practical applications use silence detection and comfort noise injection for higher coding efficiency.

In G.729B, this concept of silence detection and comfort noise injection leads to a dual-mode speech coding technique, where the different modes of input signal, denoted as active voice for speech and inactive voice for silence or background noise, are determined by a VAD. The VAD can operate externally or internally to the speech encoder. The full-rate speech coder is operational during active voice speech, but a different coding scheme is employed for the inactive voice signal, using fewer bits and resulting in a higher overall average compression ratio. The output of the VAD may be called a voice activity decision. The voice activity decision is either 1 or 0 (on or off), indicating the presence or absence of voice activity, respectively. The VAD algorithm and the inactive voice coder, as well as the G.729 or G.729A speech coders, operate on frames of digitized speech.

FIG. 1 illustrates conventional speech coding system 100, including encoder 101, communication channel 125 and decoder 102. As shown, encoder 101 includes VAD 120, active voice encoder 115 and inactive voice encoder 110. VAD 120 determines whether input signal 105 is a voice signal. If VAD 120 determines that input signal 105 is a voice signal, VAD output signal 122 causes input signal 105 to be routed to active voice encoder 115 and then routed to the output of active voice encoder 115 for transmission over communication channel 125. On the other hand, If VAD 120 determines that input signal 105 is not a voice signal, VAD output signal 122 causes input signal 105 to be routed to inactive voice encoder 110 and then routed to the output of inactive voice encoder 110 for transmission over communication channel 125. Further, VAD output signal 122 is also transmitted over communication channel 125 and received by decoder 102 as coding mode 127, such that at the other end, coding mode 127 controls whether the coded signal should be decoded using inactive voice decoder 130 or active voice decoder 135 to produce output signal 140.

When active voice encoder 115 is operational, an active voice bitstream is sent to active voice decoder 135 for each frame. However, during inactive periods, inactive voice encoder 110 can choose to send an information update called a silence insertion descriptor (SID) to the inactive decoder, or to send nothing. This technique is named discontinuous transmission (DTX). When an inactive voice is declared by VAD 120, completely muting the output during inactive voice segments creates sudden drops of the signal energy level which are perceptually unpleasant. Therefore, in order to fill these inactive voice segments, a description of the background noise is sent from inactive voice encoder 110 to inactive voice decoder 130. Such a description is known as a silence insertion description. Using the SID, inactive voice decoder 130 generates output signal 140, which is perceptually equivalent to the background noise in the encoder. Such a signal is commonly called comfort noise, which is generated by a comfort noise generator (CNG) within inactive voice decoder 130.

Due to an increase in deployment and use of VoIP applications, certain deficiencies of speech coding algorithms and, in particular, existing VAD algorithms have surfaced. For example, it has been experienced that the VAD erroneously may go off (indicative of inactive voice) at the tail end of a voice signal, although the voice signal is still present. As a result, the tail end of the voice signal is cut off by the VAD. FIG. 2 is an illustration of this first problem, where VAD 120 goes off at point 210, where voice signal still continues, and thus VAD 120 cuts off the tail end of voice signal 212. In other words, the CNG matches the energy of the tail end of the voice signal (i.e. energy of the signal after VAD goes off) for generating the comfort noise. Because the matched energy is not that of a silence or background noise signal, but the matched energy is that of the tail end of a voice signal, the comfort noise that is generated by the CNG sounds like an annoying breathe-like noise.

In a further problem, it has been determined that existing VADs occasionally misinterpret a high-level tone signal as an inactive voice or background noise, which results in the CNG generating a comfort noise by matching the energy of the high-level tone signal.

Other VAD problems may also be caused due to untimely or improper initialization or update of the noise state during the VAD operation. It is known that the background noise can change considerably during a conversation, for example, by moving from a quiet room to a noisy street, a fast-moving car, etc. Therefore, the initial parameters indicative of the varying characteristics of background noise (or the noise state) must be updated for adaptation to the changing environment. However, when the background noise parameters are not timely or properly updated or initialized, various problems may occur, including (a) undesirable performance for input signals that start below a certain level, such as around 15 dB, (b) undesirable performance in noisy environments, (c) waste of bandwidth by excessive use of SID frames, and (d) incorrect initialization of noise characteristics when noise is missing at the beginning of the speech. As an example, when the incoming signal starts with silence followed by a sudden change in the level of noise signal, existing VADs do not initialize the noise state correctly, which can lead to the noise signal following the silence erroneously being considered as the active voice by the VAD. As a result of this improper initialization of the noise state, the VAD may go on during background noise periods causing an active voice mode selection, where the bandwidth is wasted for coding of the background noise.

Therefore, there is an intense need for a robust VAD algorithm that can overcome the existing problems and deficiencies in the art.

SUMMARY OF THE INVENTION

The present invention is directed to system and method for voice activity detection. In one aspect of the present invention, there is provided a voice activity detection method for indicating an active voice mode and an inactive voice mode. The method comprises receiving an input signal having a plurality of frames; determining whether each of the plurality of frames includes an active voice signal or an inactive voice signal; resetting an inactive voice counter and incrementing an active voice counter for each of the plurality of frames that is determined to include the active voice signal; resetting the active voice counter and incrementing the inactive voice counter for each of the plurality of frames that is determined to include the inactive voice signal; setting a voice flag if the active voice counter exceeds a first threshold value; resetting the voice flag if the inactive voice counter exceeds a second threshold value; detecting a first transition from the inactive voice signal to the active voice signal; indicating the active voice mode in response to the detecting the first transition; detecting a second transition from the active voice signal to the inactive voice signal following the first transition; continuing to indicate the active voice mode for a first period of time after the detecting the second transition if the voice flag is set and for a second period of time after the detecting the second transition if the voice flag is reset, wherein the first period of time is longer than the second period of time; and indicating the inactive voice mode after the continuing.

In one aspect, the first threshold value is equal to the second threshold value. In a further aspect, the method comprises measuring a signal-to-noise ratio (SNR) of the input signal; and setting the voice flag if the SNR exceeds a third threshold value.

In another aspect, the determining whether each of the plurality of frames includes the active voice signal or the inactive voice signal uses one or more thresholds, and wherein the one or more thresholds are adapted based on the voice flag. For example, the one or more thresholds are adapted to favor determining the active voice signal if the voice flag is set and are adapted to favor determining the inactive voice signal if the voice flag is reset.

In yet another aspect, the method continues to indicate the active voice mode for a third period of time after the detecting the second transition if the voice flag is set and an energy level of the input signal exceeds an energy threshold, and wherein the third period of time is greater than the first period of time.

In a separate aspect, there is provided a voice activity detection method for indicating an active voice mode and an inactive voice mode, where the method comprises receiving a first portion of an input signal; determining that the first portion of the input signal includes an active voice signal; indicating the active voice mode in response to the determining that the first portion of the input signal includes the active voice signal; receiving a second portion of the input signal immediately following the first portion of the input signal; determining that the second portion of the input signal includes an inactive voice signal; extending the indicating the active voice mode for a period of time after the determining that the second portion of the input signal includes the inactive voice signal, wherein the period of time varies based on one or more conditions; and indicating the inactive voice mode after expiration of the period of time.

In one aspect, the period of time varies based on a length of time the active voice mode is indicated in response to the determining that the first portion of the input signal includes the active voice signal. For example, the period of time may increase as the length of time increases.

In another aspect, the period of time varies based on an energy level of the input signal after the determining determines that the second portion of the input signal includes the inactive voice signal. For example, the period of time may increase as the energy level increases.

In an additional aspect, the period of time varies based on an energy level of the input signal after the determining determines that the second portion of the input signal includes the inactive voice signal. For example, the period of time may increase as the energy level increases.

In other aspects, there is provided a voice activity detector comprising an input configured to receive an input signal having a plurality of frames, and an output configured to indicate an active voice mode or an inactive voice mode, where the voice activity detector operates according to the above-described methods of the present invention.

These and other aspects of the present invention will become apparent with further reference to the drawings and specification, which follow. It is intended that all such additional systems, features and advantages be included within this description, be within the scope of the present invention, and be protected by the accompanying claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1:
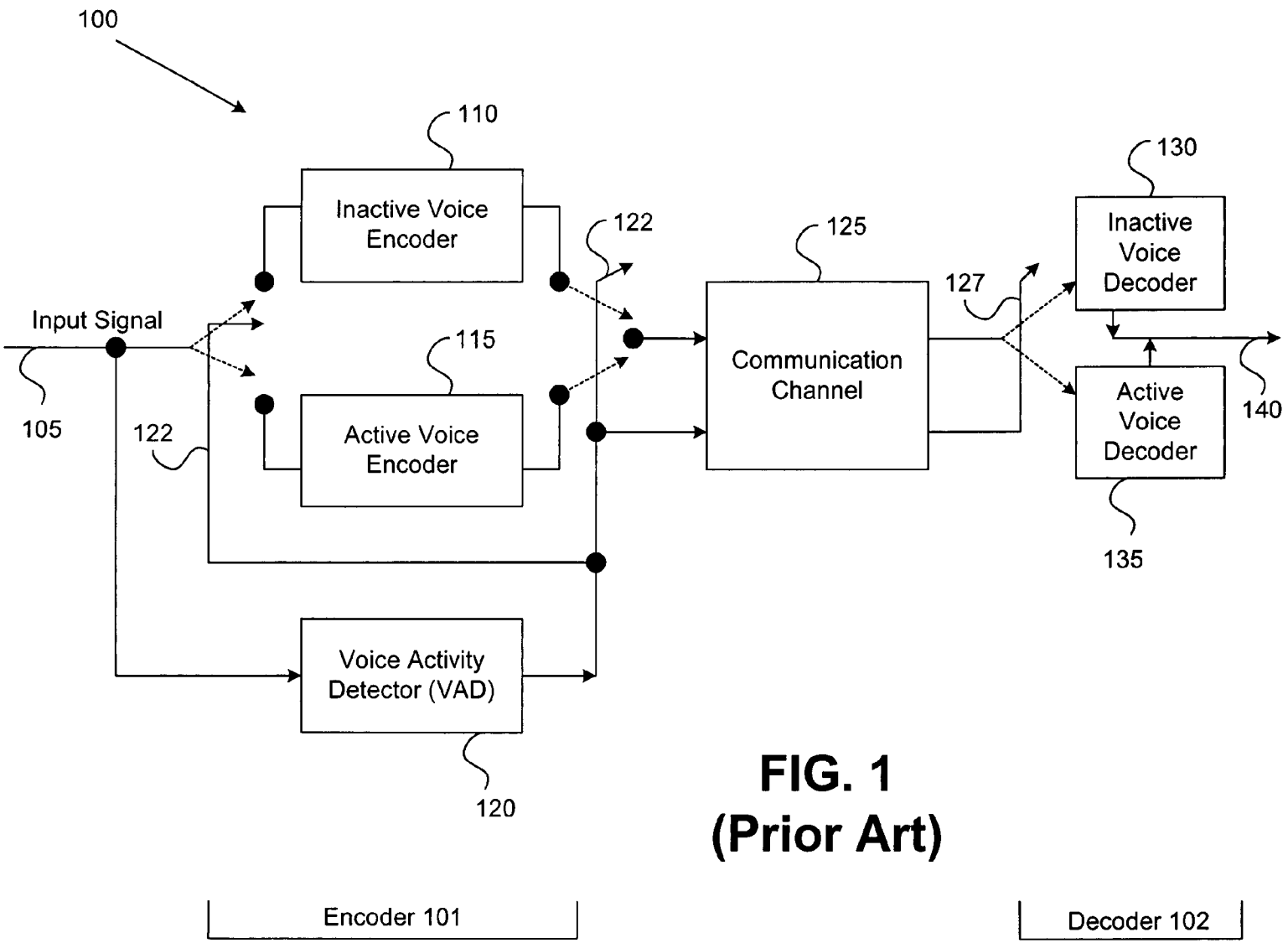
FIG. 1 (Prior Art)
FIG. 1 illustrates a conventional speech coding system including a decoder, a communication channel and an encoder having a VAD.

Although the invention is described with respect to specific embodiments, the principles of the invention, as defined by the claims appended herein, can obviously be applied beyond the specifically described embodiments of the invention described herein. For example, although various embodiments of the present invention are described in conjunction with the VAD algorithm of the G.729B, the invention of the present application is not limited to a particular standard, but may be utilized in any VAD system or algorithm. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

Figure 2:
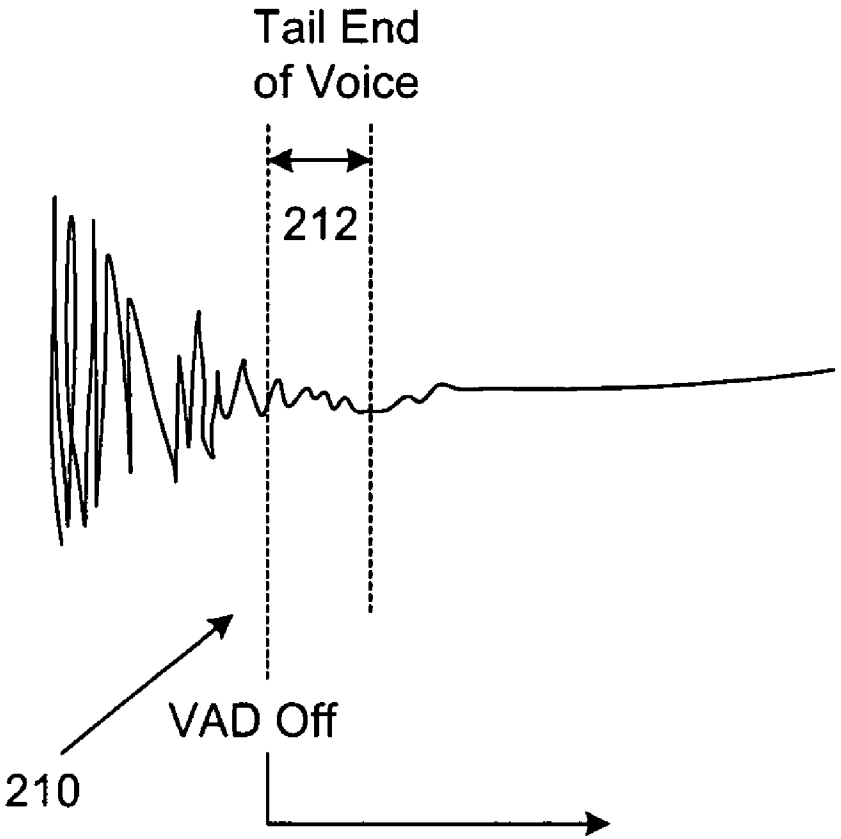
FIG. 2 is an illustrative diagram of a problem in conventional VADs, where the VAD goes off at a point where voice signal still continues and the tail end of the voice signal is cuts off.
Figure 3:
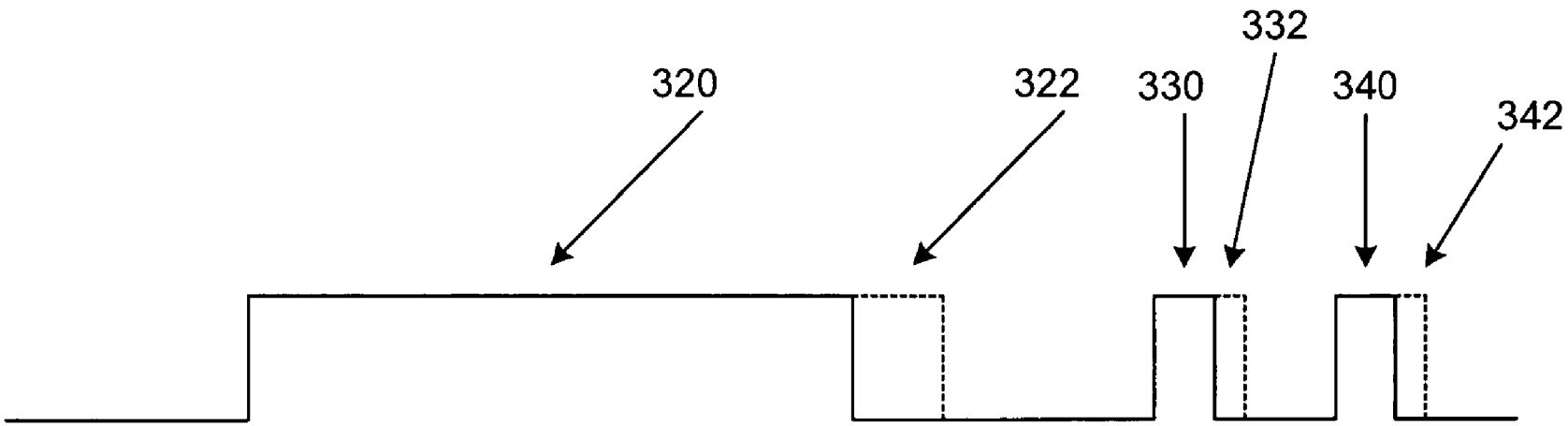
FIG. 3 illustrates the status of VAD mode selection versus time, where VAD voice mode is adaptively extended after detection of an inactive voice signal to remedy the problem of FIG. 2, according to one embodiment of the present invention.

As described above in conjunction with FIG. 2, in conventional VADs, while the voice signal is still being received, the VAD may improperly go off and, thus, cause the tail end of voice signal being cut off. The tail end is cut off because the CNG matches the energy of the tail end of the voice signal (i.e. energy of the signal after VAD goes off) for generating the comfort noise. To resolve this problem, the present application adaptively extends the active voice mode after VAD 120 goes off, as shown in FIG. 3. FIG. 3 depicts the status of VAD mode selection versus time. For example, during time period 320, VAD 120 indicates active voice. When VAD 120 goes off at the end of time period 320, existing VADs indicate an inactive voice mode, which causes the tail end of voice signal (see 212) to be cut. However, as shown in FIG. 3, the present application extends time period 320 by adding VAD on-time extension period 322, during which time period, VAD output remains high to indicate an active voice mode to avoid cutting off the tail end of the voice signal. According to one embodiment of the present invention, the period of time to extend the VAD on-time to indicate an active voice mode, after VAD determines that voice signal has ended, is selected adaptively, and not by adding a constant extension. For example, as shown in FIG. 3, VAD on-time extension period 322 is longer than VAD on-time extension period 332 or 334. It should be noted that adding a constant VAD on-time extension period is undesirable, because communication bandwidth is wasted by coding the incoming signal as voice, where the incoming signal is not a voice signal. The present invention overcomes this drawback by adaptively adjusting the VAD on-time extension period.

In one embodiment of the present invention, the VAD on-time extension period is calculated based on the amount of time the preceding voice signal, e.g. voice signal 320, is present, which can be referred to as the active voice length. The longer the preceding voice period before VAD goes off, the longer the VAD on-time extension period after VAD goes off. As shown in FIG. 3, voice period 320 is longer than voice periods 330 and 340, and thus, VAD on-time extension period 322 is longer than VAD on-time extension periods 332 or 334.

In another embodiment of the present invention, the VAD on-time extension period is calculated based on the energy of the signal about the time VAD goes off, e.g. immediately after VAD goes off. The higher the energy, the longer the VAD on-time extension period after VAD goes off.

In yet another embodiment, various conditions may be combined to calculate the VAD on-time extension period. For example, the VAD on-time extension period may be calculated based on both the amount of time the preceding voice signal is present before VAD goes off and the energy of the signal shortly after the VAD goes off. In some embodiments, the VAD on-time extension period may be adaptive on a continuous (or curve) format, or it may be determined based on a set of pre-determine thresholds and be adaptive on a step-by-step format.

Figure 4A:
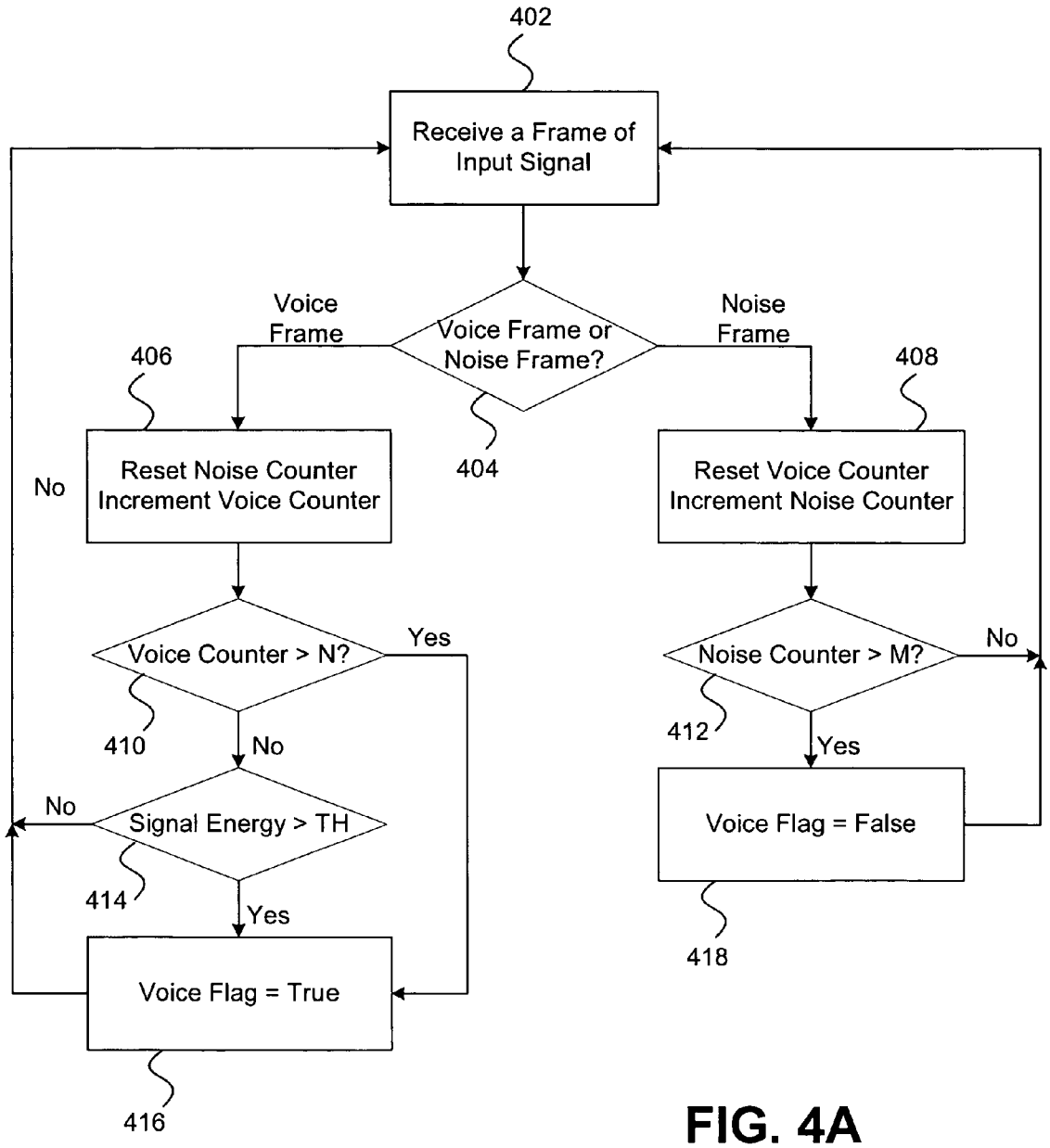
FIG. 4A illustrates a flow diagram for determining a voice mode status for adaptively extending VAD voice mode, according to one embodiment of the present invention.

FIG. 4A illustrates a flow diagram for determining an adjustment factor for use to adaptively extend the voice mode of the VAD, according to one embodiment of the present invention. As shown, in step 402, the VAD receives a frame of input signal 105. Next, at step 404, the VAD determines whether the frame includes active voice or inactive voice (i.e., background noise or silence.) If the frame is a voice frame, the process moves to step 406, where the VAD initializes a noise counter to zero and increments a voice counter by one. At step 410, it is decided whether the voice counter exceeds a predetermined number (N), e.g. N=8. If the voice counter exceeds the predetermined number (N), the process moves to step 416, where a voice flag is set, where the voice flag is used to adaptively determine a VAD on-time extension period. However, if the voice counter does not exceed the predetermined number (N), the process moves to step 414, where it is determined whether the signal energy, e.g. signal-to-noise ratio (SNR), exceeds a predetermined threshold, such as SNR>1.4648 dB. If the signal energy is sufficiently high, the process moves to step 416 and the voice flag is set.

Turning back to step 404, if the frame is a noise frame, the process moves to step 408, where the VAD initializes the voice counter to zero and increments the noise counter by one. At step 412, it is decided whether the noise counter exceeds a predetermined number (M), e.g. M=8. If the noise counter exceeds the predetermined number (M), the process moves to step 418, where a voice flag is reset, where the voice flag is used to adaptively determine a VAD on-time extension period.

Figure 4B:
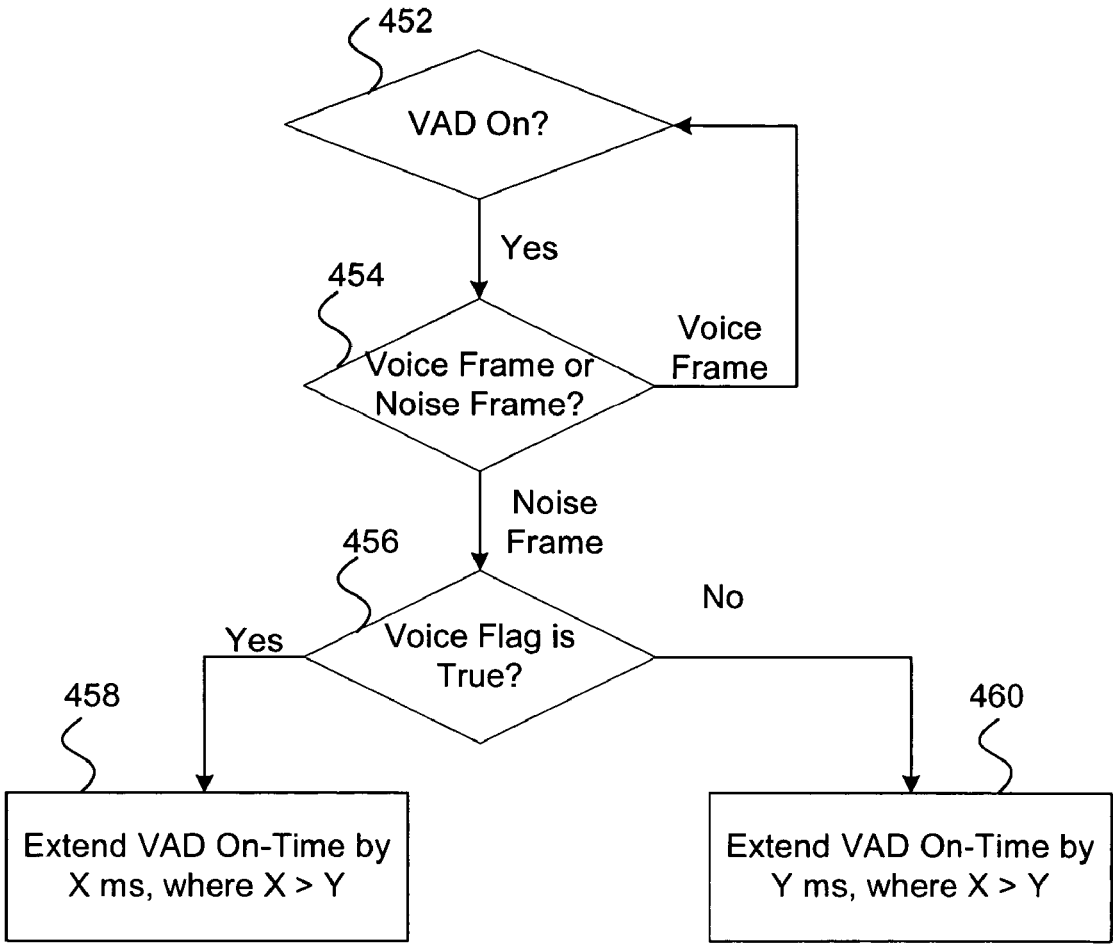
FIG. 4B illustrates a flow diagram for adaptively extending VAD voice mode using the voice mode status of FIG. 4B, according to one embodiment of the present invention.

FIG. 4B illustrates a flow diagram for adaptively extending the voice mode of the VAD, according to one embodiment of the present invention. At step 452, it is determined if VAD output signal 122 is on, which is indicative of voice activity detection. If so, the process moves to step 454, where it is determined if the present frame is a voice frame or a noise frame. If the present frame is the voice frame, the process moves back to step 452 and awaits the next frame. However, if the present frame is a noise frame, the process moves to step 456. Unlike the conventional VADs, upon the detection of the noise frame, VAD output signal 122 is not turned off or a constant extension period is not added to maintain the on-time of VAD output signal 122. Rather, according to the present invention, at step 456, it is determined whether the voice flag is set. If so, the process moves to step 458 and the on-time for VAD output signal 122 is extended by a first period of time (X), such as an extension of time by five (5) frames, which is 50 ms for 10 ms frames. Otherwise, the process moves to step 460, where the on-time for VAD output signal 122 is extended by a second period of time (Y), where X>Y, such as an extension of time by two (2) frames, which is 20 ms for 10 ms frames. Furthermore, in one embodiment (not shown), at step 458, the on-time for VAD output signal 122 may be extended by a third period of time (Z) rather than (X), where Z>X, such as an extension of time by eight (8) frames, which is 80 ms for 10 ms frames, if the VAD determines that the signal energy is above a certain threshold, e.g. when the current absolute signal energy is more than 21.5 dB. The attached Appendix discloses one implementation of the present invention, according to FIGS. 4A and 4B.

In another embodiment of the present application, a set of thresholds are utilized at step 404 (or 454) to determine whether the input frame is a voice frame or a noise frame. In one embodiment, these thresholds are also adaptive as a function of the voice flag. For example, when the voice flag is set, the threshold values are adjusted such that detection of voice frames are favored over detection of noise frames, and conversely, when the voice flag is reset, the threshold values are adjusted such that detection of noise frames are favored over detection of voice frames.

Turning to another problem, as discussed above, conventional VADs sometimes misinterpret a high-level tone signal as an inactive voice or background noise, which results in the CNG generating a comfort noise that matches the energy of the high-level tone signal. To overcome this problem, the present application provides solutions to distinguish tone signals from background noise signals. For example, in one embodiment, the present application utilizes the second reflection coefficient (or $k_2$) to distinguish between tone signals and background noise signals. Reflection coefficients are well known in the field of speech compression and linear predictive coding (LPC), where a typical frame of speech can be encoded in digital form using linear predictive coding with a specified allocation of binary digits to describe the gain, the pitch and each of ten reflection coefficients characterizing the lattice filter equivalent of the vocal tract in a speech synthesis system. A plurality of reflection coefficients may be calculated using a Leroux-Gueguen algorithm from autocorrelation coefficients, which may then be converted to the linear prediction coefficients, which may further be converted to the LSFs (Line Spectrum Frequencies), and which are then quantized and sent to the decoding system.

Figure 5A:
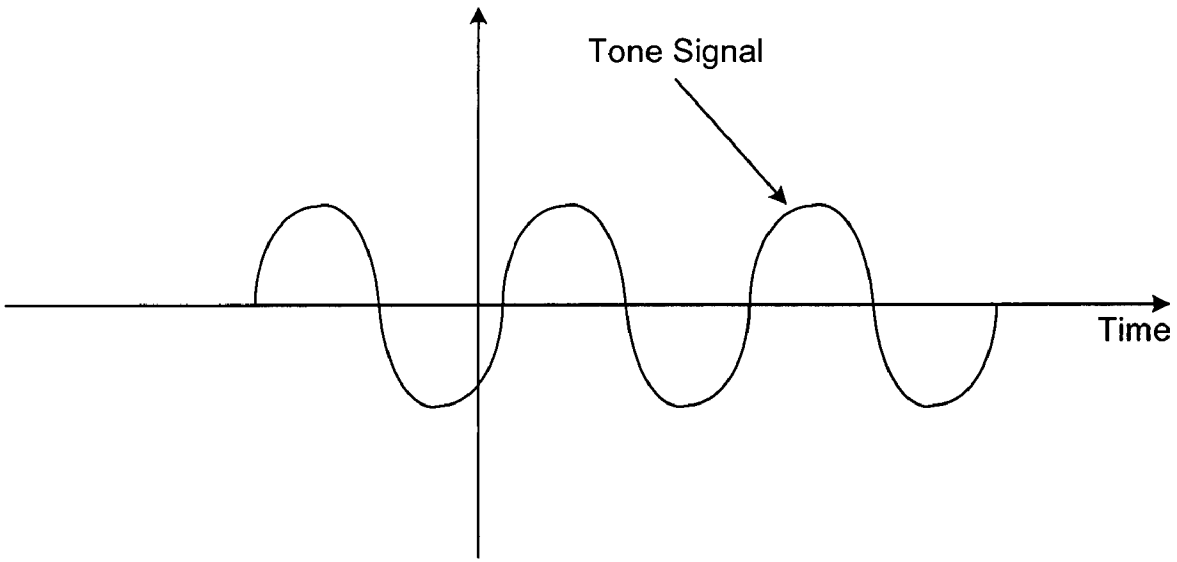
FIG. 5A illustrates a tone signal having a sinusoidal shape in the time domain as stable as a background noise signal.
Figure 5B:
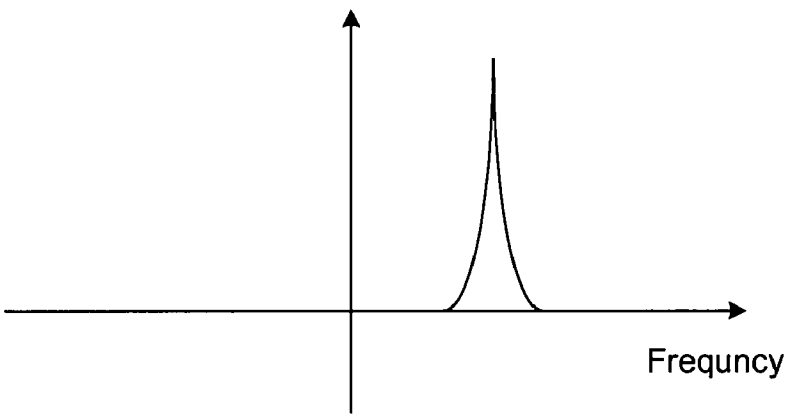
FIG. 5B illustrates the tone signal of FIG. 5A in the spectrum domain having a sharp formant unlike a background noise signal.

As shown in FIG. 5A, a tone signal has a sinusoidal shape in the time domain as stable as a background noise signal. However, as shown in FIG. 5B, the tone signal has a sharp formant in the spectrum domain, which distinguishes the tone signal from a background noise signal, because background noise signals do not represent such sharp formants in the spectrum domain. Accordingly, the VAD of the present application utilizes one or more parameters for distinguishing between tone signals and background noise signals to prevent the VAD from erroneously indicating the detection of background noise signals or inactive voice signal when tone signals are present.

Figure 6:
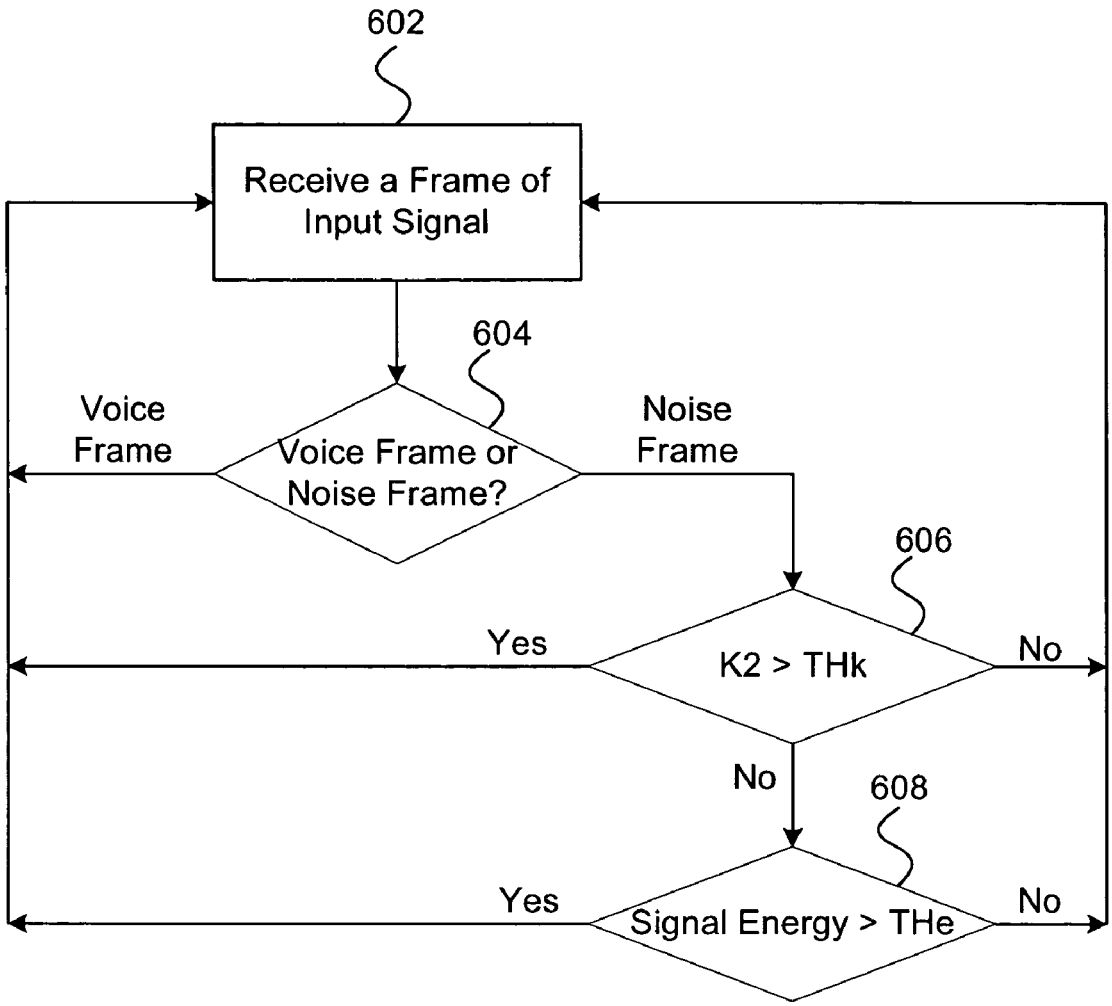
FIG. 6 illustrates a flow diagram for use by a VAD of the present invention for distinguishing between tone signals and background noise signals, according to one embodiment of the present invention.

FIG. 6 illustrates a flow diagram for use by a VAD of the present invention for distinguishing between tone signals and background noise signals. As shown, at step 602, the VAD receives a frame of input signal. Next, at step 604, the VAD determines whether the frame includes an active voice or an inactive voice (i.e., background noise or silence.) If the frame is determined to be a voice frame, the process moves back to step 602 and the VAD indicates an active voice mode. However, if the frame is determined to be an inactive voice frame, such as a noise frame, then the process moves to step 606. Unlike conventional VADs, the VAD of the present invention does not indicate an inactive voice mode upon the detection of the inactive voice signal, but at step 606, the second reflection coefficient ($K_2$) of the input signal or the frame is compared against a threshold ($TH_k$), e.g. 0.88 or 0.9155. If the VAD determines that the second reflection coefficient ($K_2$) is greater than $TH_k$, the process moves to step 602 and the VAD indicates an active voice mode. Otherwise, in one embodiment (not shown), if the VAD determines that the second reflection coefficient ($K_2$) is not greater than $TH_k$, the process moves to step 602 and the VAD indicates an inactive voice mode.

Yet, in another embodiment, background noise signals and tone signals may further be distinguished based on signal stability, since tone signals are more stable than noise signals. To this end, if the VAD determines that the second reflection coefficient ($K_2$) is not greater than $TH_k$, the process moves to step 608 and the VAD compares the signal energy of the input signal or the frame against an energy threshold ($TH_e$), e.g. 105.96 dB. At step 608, if the VAD determines that the signal energy is greater than THE, the process moves to step 602 and the VAD indicates an active voice mode. Otherwise, in one embodiment, if the VAD determines that the signal energy is not greater than $TH_e$, the process moves to step 602 and the VAD indicates an inactive voice mode.

In another embodiment (not shown), if the VAD determines that the signal energy is not greater than $TH_e$, signal stability may further be determined based on the tilt spectrum parameter ($\gamma_1$) or the first reflection coefficient of the input signal or the frame. In one embodiment, the tilt spectrum parameter ($\gamma_1$) is compared between the current frame and the previous frame for a number of frames, e.g. (|current $\gamma_1$−previous $\gamma_1$|) is determined for 10-20 frames, and a determination is made based on comparing with pre-determined thresholds, and the signal is classified as one of tone signals, background noise signals or active voice signals based on the signal stability. For example, if the result of (|current $\gamma_1$−previous $\gamma_1$|) for each frame of a plurality of frames is greater than a tone signal stability threshold, then the VAD will continue to indicate an active voice mode. Further, it should be noted that each of the second reflection coefficient ($K_2$), the signal energy and the tilt spectrum parameter ($\gamma_1$) can be used solely or in combination with one or both of the other parameters for distinguishing between tone signals and background noise signals. The attached Appendix discloses one implementation of the present invention, according to FIG. 6.

Now, turning to other VAD problems caused by untimely or improper update of the noise state, the present application provides an adaptive noise state update for resetting or reinitializing the noise state to avoid various problems. It should be noted that a constant noise state update rate can cause problems, e.g. every 100 ms, because the reset or re-initialization of the noise state may occur during active voice area and, thus, cause low level active voice to be cut off, as a result of an incorrect mode selection by the VAD.

Figure 7:
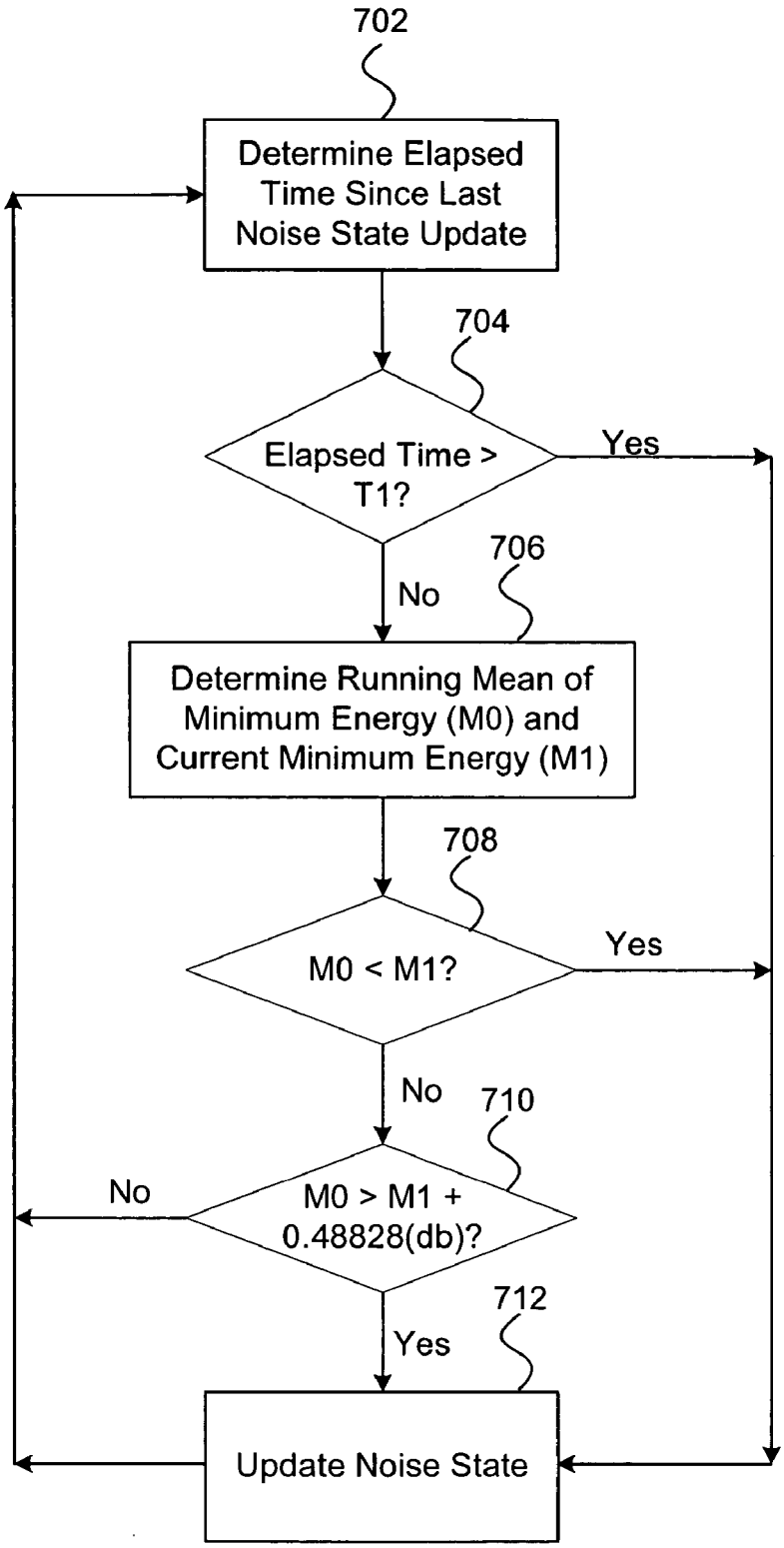
FIG. 7 illustrates a flow diagram for adaptively updating the noise state of a VAD, according to one embodiment of the present invention.

FIG. 7 illustrates a flow diagram for adaptively updating the noise state of a VAD, according to one embodiment of the present invention. As shown, at step 702, the amount of time elapsed since the last time the noise state was updated is determined. Next, at step 704, it is determined whether the amount of time exceeds a predetermined period of time (T1). For example, it is known that one speech sentence is spoken in about 2.5-3.5 seconds. Accordingly, in one embodiment, the pre-determined period of time after the last update is around 3.0 seconds. Therefore, at step 704, it may be determined whether three (3) seconds has passed since the last time the noise state was updated. If so, the process moves to step 712, where the noise state is updated. Otherwise, the process moves to step 706, where the VAD determines the running mean of minimum energy ($M_0$) of the input signal, which is the average energy of the low energy of the input signal, and further determines current minimum energy (M1) of the input signal.

Figure 8:
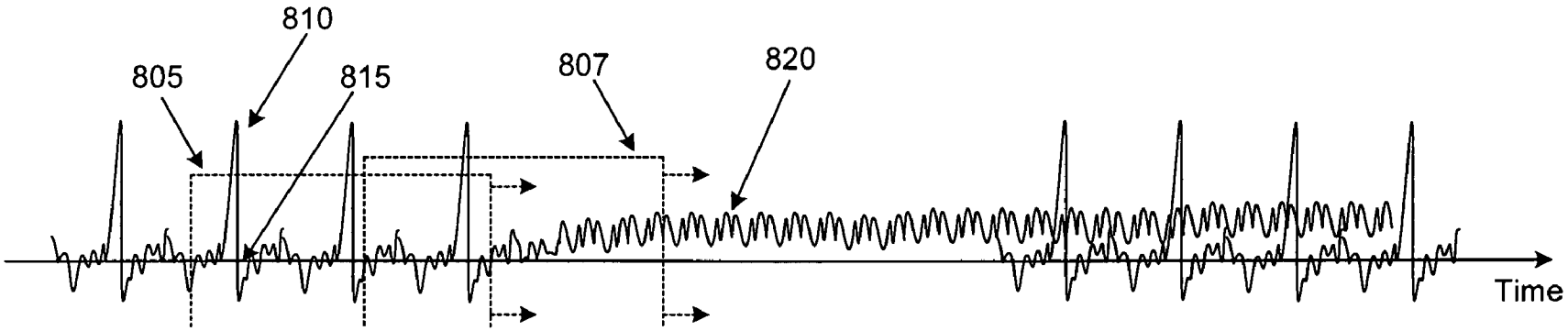
FIG. 8 illustrates an input signal, where the noise level changes from a first noise level to a second noise level, and where a shifting window is used to measure the minimum energy is of the input signal.

Referring to FIG. 8 of the present application, input signal 810 is shown, where the noise level changes from first noise level 815 to second noise level 820. Further, FIG. 8 shows a shifting window within which the minimum energy is measured. For example, the minimum energy within first window 805 is lower than the minimum energy within second window 807 due to the introduction of second noise level 820 in second window 807. In one embodiment of the present invention, the shifting window shifts according to time and the minimum energy is measured as the shift occurs. The running mean of minimum energy ($M_0$) of the input signal is calculated based on the measurement of the minimum energy of a number of windows, and the current minimum energy (M1) is the measurement of the minimum energy within the current window.

Turning back to FIG. 7, after step 706, the process moves to step 708, where the VAD determines whether the running mean of minimum energy ($M_0$) of the input signal is less than the current minimum energy ($M_1$), i.e. $M_0<M_1$. Of course, without departing from the concept of the present invention, in some embodiments, a first predetermined value may be added to or subtracted from M1 prior to the comparison, i.e. $M_0<M_1-0.015625$ (dB). If the result of the comparison is true, e.g. $M_0$ is less than $M_1$, then the process moves to step 712, where the noise state is updated. Otherwise, the process moves to step 710, where the VAD determines whether the running mean of minimum energy ($M_0$) of the input signal is greater than the current minimum energy ($M_1$) plus a second predetermined value, e.g. 0.48828 (dB), i.e. $M_0>M_1+0.48828$ (dB). If so, then the process moves to step 712, where the noise state is updated. Otherwise, the process returns to step 702.

In one embodiment (not shown), at step 712, prior to updating the noise state, the VAD considers the signal energy prior to updating the noise state to avoid updating the noise state during active voice signal, such that low level active voice can be cut off by the VAD. In other words, the VAD determines whether the signal energy exceeds an energy threshold, and if so, the VAD delays updating the noise state until the signal energy is below the energy threshold. The attached Appendix discloses one implementation of the present invention, according to FIG. 7.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. For example, it is contemplated that the circuitry disclosed herein can be implemented in software, or vice versa. The described embodiments are to be considered in all respects as illustrative and not restrictive. It should also be understood that the invention is not limited to the particular embodiments described herein, but is capable of many rearrangements, modifications, and substitutions without departing from the scope of the invention.

What is claimed is:

1. A speech encoding method using a voice activity detector for indicating an active voice mode and an inactive voice mode, said method comprising:

receiving an input signal having a plurality of frames;

determining whether each of said plurality of frames includes an active voice signal or an inactive voice signal;

resetting an inactive voice counter and incrementing an active voice counter for each of said plurality of frames that is determined to include said active voice signal;

resetting said active voice counter and incrementing said inactive voice counter for each of said plurality of frames that is determined to include said inactive voice signal;

setting a voice flag in response to said active voice counter exceeding a first threshold value;

resetting said voice flag in response to said inactive voice counter exceeding a second threshold value;

detecting a first transition from said inactive voice signal to said active voice signal;

indicating said active voice mode in response to said detecting said first transition;

encoding said input signal using an active voice encoder in response to indicating said active voice mode;

detecting a second transition from said active voice signal to said inactive voice signal following said first transition;

continuing to indicate said active voice mode for a first period of time after said detecting said second transition in response to said voice flag being set and for a second period of time after said detecting said second transition in response to said voice flag being reset, wherein said first period of time is longer than said second period of time;

indicating said inactive voice mode after said continuing; and encoding said input signal using an inactive voice encoder in response to indicating said inactive voice mode.

2. The method of claim 1, wherein said first threshold value is equal to said second threshold value.

3. The method of claim 1 further comprising:

measuring a signal-to-noise ratio (SNR) of said input signal; and setting said voice flag in response to said SNR exceeding a third threshold value.

4. The method of claim 1, wherein said determining whether each of said plurality of frames includes said active voice signal or said inactive voice signal uses one or more thresholds, and wherein said one or more thresholds are adapted based on said voice flag.

5. The method of claim 4, wherein said one or more thresholds are adapted to favor determining said active voice signal in response to said voice flag being set and are adapted to favor determining said inactive voice signal in response to said voice flag being reset.

6. The method of claim 1, wherein said continuing indicates said active voice mode for a third period of time after said detecting said second transition in response to said voice flag being set and an energy level of said input signal exceeds an energy threshold, and wherein said third period of time is greater than said first period of time.

7. A speech encoding system having a voice activity detector (VAD) for indicating an active voice mode and an inactive voice mode, said speech encoding system comprising:

a microphone configured to receive a speech and generate an input signal;

an input configured to receive said input signal having and generate a plurality of frames;

an output configured to indicate said active voice mode or said inactive voice mode;

an active voice encoder; and an inactive voice encoder;

wherein said VAD is configured to determine whether each of said plurality of frames includes an active voice signal or an inactive voice signal;

wherein said VAD is configured to reset an inactive voice counter and increments an active voice counter for each of said plurality of frames that said VAD determines to include said active voice signal;

wherein said VAD is configured to reset said active voice counter and increments said inactive voice counter for each of said plurality of frames that said VAD determines to include said inactive voice signal;

wherein said VAD is configured to set a voice flag in response to said active voice counter exceeding a first threshold value;

wherein said VAD is configured to reset said voice flag in response to said inactive voice counter exceeding a second threshold value;

wherein said VAD is configured to detect a first transition from said inactive voice signal to said active voice signal;

wherein said VAD is configured to indicate said active voice mode in response to said detecting said first transition;

wherein said active voice encoder is configured to encode said speech signal in response to said VAD indicating said active voice mode;

wherein said VAD is configured to detect a second transition from said active voice signal to said inactive voice signal following said first transition;

wherein said VAD is configured to continue to indicate said active voice mode for a first period of time after said detecting said second transition in response to said voice flag being set and for a second period of time after said detecting said second transition in response to said voice flag being reset, wherein said first period of time is longer than said second period of time;

wherein said VAD is configured to indicate said inactive voice mode after said continuing; and wherein said inactive voice encoder is configured to encode said speech signal in response to said VAD indicating said inactive voice mode.

8. The speech encoding system of claim 7, wherein said first threshold value is equal to said second threshold value.

9. The speech encoding system of claim 7, wherein said VAD is configured to measure a signal-to-noise ratio (SNR) of said input signal, and wherein said VAD is further configured to set said voice flag in response to said SNR exceeding a third threshold value.

10. The speech encoding system of claim 7, wherein said VAD uses one or more thresholds to determine whether each of said plurality of frames includes said active voice signal or said inactive voice signal, and wherein said VAD is configured to adapt said one or more thresholds based on said voice flag.

11. The speech encoding system of claim 10, wherein said VAD is configured to adapt said one or more thresholds to favor determining said active voice signal in response to said voice flag being set and to favor determining said inactive voice signal in response to said voice flag being reset.

12. The speech encoding system of claim 7, wherein said VAD is configured to continue to indicate said active voice mode for a third period of time after detecting said second transition in response to said voice flag being set and an energy level of said input signal exceeds an energy threshold, and wherein said third period of time is greater than said first period of time.

* * * * *